US008330031B2

(12) United States Patent
Taninbaum

(10) Patent No.: US 8,330,031 B2
(45) Date of Patent: Dec. 11, 2012

(54) HIGH HAT TAMBOURINE ASSEMBLY

(76) Inventor: Richard L. Taninbaum, Mamaroneck, NY (US)

( * ) Notice: Subject to any disclaimer, the term of this patent is extended or adjusted under 35 U.S.C. 154(b) by 0 days.

(21) Appl. No.: 13/354,955

(22) Filed: Jan. 20, 2012

(65) Prior Publication Data

US 2012/0186415 A1 Jul. 26, 2012

Related U.S. Application Data

(60) Provisional application No. 61/434,710, filed on Jan. 20, 2011.

(51) Int. Cl.
*G10D 13/02* (2006.01)

(52) U.S. Cl. ..... 84/418

(58) Field of Classification Search ..... 84/402–418
See application file for complete search history.

(56) References Cited

U.S. PATENT DOCUMENTS 4,346,637 A * 8/1982 Janszen ..... 84/418

* cited by examiner

*Primary Examiner* — Kimberly Lockett
(74) *Attorney, Agent, or Firm* — Lackenbach Siegel, LLP; Myron Greenspan

(57) ABSTRACT

A high hat tambourine assembly includes a circular frame and a hub coextensive with the frame axis and has an elongate axial channel dimensioned to receive a rod of a high hat for free relative slidable movements. Quick-release arms are mounted on the hub and normally biased to provide an opening that is smaller than axial channel and having manually engageable gripping members that frictionally engage the rod with a force sufficient to normally secure said hub to the rod. The arms can be manually gripped by the hand of the user and actuated to separate the gripping members to enlarge the normally restricted opening to allow the rod to freely pass. A plurality of jingles are secured to the frame. The high hat tambourine assembly can be quickly and conveniently mounted on or released from the rod with one hand of the user.

20 Claims, 4 Drawing Sheets

HIGH HAT TAMBOURINE ASSEMBLY

CROSS REFERENCE TO RELATED APPLICATION

This application is related to Provisional Patent application Ser. No. 61/434,710 filed on Jan. 20, 2011.

BACKGROUND OF THE INVENTION

1. Field of the Invention

This invention generally relates to musical instruments and, more specifically, to a high hat tambourine assembly that can be quickly and conveniently mounted on or removed from a cymbal high-hat pull rod.

2. Description of the Prior Art

High hats are typically formed of two cymbals that are mounted on a stand, one on top of the other, and stacked together one of which is linked to a pedal on the stand. A narrow metal shaft or rod, sometimes referred to as a pull rod, runs through both cymbals into a hollow tube and connects to the pedal on the floor. The top cymbal is connected to the pull rod with a clutch, while the bottom cymbal remains stationary resting on the hollow tube. When the foot plate is actuated by pressing it downwardly, the top cymbal crashes into the bottom cymbal to create percussion sounds that are frequently used in a various genres of music, including disco, jazz, rock-and-roll and other forms of contemporary, and popular music.

Drummers are always interested in developing new and creative percussion sounds, many of which become quite complex. Drummers typically use both hands and at least one foot to strike a plurality of drums, cymbals, base drums, sneer drums and high hats. However, because drummers have only two hands and two feet some of the complexities are introduced by adding percussion instruments that can be actuated independently or simultaneously with other strokes or movements by the drummer. Thus, the assignee of the subject invention, Rhythm Tech Inc. of New Rochelle, N.Y. developed and has marketed a mounted percussion device that included tambourines designed for mounting on high-hat pull rods. Their light weight and small diameter allowed intricate patterns to be played without altering the feel of the high-hat pedal. These high-hat accessories have been marketed by Rhythm Tech under its registered trademark "HAT TRICK"®. The original device featured eight pairs of jingles while the double device had sixteen. Both models have been available with polished brass jingles and constructed from an all steal frame with a black, powder coat finish. These accessories have been and continue to be sold by Rhythm Tech under the following model numbers:

RT7400 The "Hat Trick"®

RT7402 "The Double "Hat Trick"®

RT7410 The "Hat Trick"®

RT7412 The Double "Hat Trick"®

The tambourine accessories for use in this manner, however, were mounted on the high-hat pull rods by means of a screw wing nut on both the single and the double units. This necessitated that the drummer tightens or loosens the wing nut by rotating them, partial or multiple turns, and then gripping the jingle device to lift it or mount it on a pull rod. Also, this has typically been a two hand operation since the accessory would need to be held in position by one hand while the other hand was used to manipulate the wing nut. This necessarily interfered with and interrupted the drummer's stride and ability to provide continuous uninterrupted percussion sounds. This has been proven to be inconvenient than many drummers would like, since drummers are normally under pressure to instantaneously change the percussion sounds that they produce, and even in the middle of a single song or piece of music, so that any such activities as modifying the instruments used are mostly or completely undetected by the listening audience.

In U.S. Pat. No. 4,960,028 a quick-release cymbal mounting fastener is disclosed. However, this patent teaches the use of a quick-release mounting device for securing a cymbal on a simple upright cymbal support rod. The support rod includes an enlarged diameter region forming a support surface integral with the rod intended to support the cymbal. The cymbal, the central portion of which is imbedded within thick support washers below and above the cymbal, can to be lowered from the upper free end of the post which is threaded to rest on the enlarged post support surface. The quick-release mounting fastener is formed of a pair half-round sleeve members arranged in face-to-face relationship to form a cylindrical surface for contacting with the rod. The sleeve support members are made of plastic so that they are slightly deformable to conform to the outline of the rod surface, should it have threads cut therein. A layer of a flexible material, such an elastomeric foam can be attached to the cylindrical surfaces to form a bendable surface for squeezing against the rod surface so that the fastener may be used on a wide range of sizes of threads that are cut or formed in a rod surface. However, the quick-release mechanism is used to primarily secure the cymbal and the felt from moving upwardly on the rod or post, as the cymbal itself is relatively heavy and the weight of the cymbal will normally bear downwardly on the post support surface due to gravity. The quick-release mechanism, therefore, is used simply to ensure that the cymbal does not inadvertently lift from the support surface, although the forces created by the quick-release device need not to be very demanding since, as indicated, the weight of the cymbal itself and the downward force acting thereon will generally prevent the cymbal from lifting above the support surface under normal use conditions. Accordingly, the use of a plastic or even elastomeric foam between the sleeve members and the post would normally provide relatively little friction, especially on a very smooth chrome plated steel pull rod of the type normally used with high hats.

SUMMARY OF THE INVENTION

Accordingly, it is an object of the invention to provide a high hat tambourine accessory assembly that overcomes the disadvantages of the prior art or known tambourine accessories for high hats.

It is another object of the invention to provide a high hat tambourine assembly that is simple in construction and economical to manufacture.

It is still another object of the invention to provide a high hat tambourine accessory of the type under the discussion that can be quickly and conveniently mounted on a high-hat pull rod or quickly removed from such rod with a single hand.

It is yet another object of the invention to provide a high hat tambourine accessory as suggested in the previous objects, that utilizes a quick-release mechanism for enabling a drummer to grip the mechanism with a single hand and almost instantaneously mount or remove the tambourine accessory without losing any significant beats.

It is a further object of the invention to provide a high hat tambourine assembly as in the previous objects that includes a rim that mounts at least a set of jingles that and a rim that can be struck with a drumstick to produce additional and varied percussion sounds.

It is still a further object of the invention to provide high hat tambourine assembly as in the previous object in which the supporting rim and the rim accessible for striking with a drumstick are formed of different materials having different hardness characteristics.

It is yet another object of the invention to provide a high hat tambourine assembly that can withstand significant downward pressures or forces applied to the device notwithstanding that is held on a pull rod of a high-hat that is generally very polished and smooth.

It is an additional object of the invention to provide a high hat tambourine assembly as in the previous object that can withstand downward loads or forces within a range of 6-15 lb without slippage relative to the movable pull rod of the high hat assembly to ensure that the assembly will not descend due to up and down movements of the pull rod or striking forces and come into contact with the upper or movable cymbal of the high hat.

In order to achieve the above objects of the invention, as well as others that will become apparent hereinafter, the high hat tambourine assembly in accordance with the present invention includes at least one generally circular ring provided with support members in the form of generally diametrical cross members that are inwardly curved towards the center or axis of the circular ring. In the space between the curved cross members a but is secured to the cross members that is fixed relative to the ring. Manually actuatable quick-release arms are mounted on the hub for pivoting action and are normally biased to provide a lower opening that is generally smaller then an elongate axial channel through the hub. A pull rod of the high hat extends through the axial channel with some tolerance for allowing free slideable movements between the rod and the hub. However, the lower opening formed by the release arms, being restricted in size, engages the rod and provide gripping members that frictionally engage the rod with a force sufficient to secure the hub and the ring to the pull rod to prevent slipping notwithstanding any downward striking forces applied to the ring. When the high hat tambourine assembly is to be removed or mounted on the rod, the quick-release mechanism is gripped by the hand of the user and squeezed to separate the frictionally engaging members to enlarge the normally restricted opening to allow the pull rod to freely pass therethrough. The specific nature of the quick-release mechanism used to mount or remove the device from the pull rod is not critical and any quick-release mechanism suitable for this purpose can be used. With this arrangement, the device can be quickly and conveniently mounted or released with one hand of the user. Jingles are secured to the ring, either along just one edge, such as the lower edge, or on both opposing edges, such as the lower and upper edges, and populated with jingles to provide the desired number of jingles for any given application. With this arrangement, there is no need for separate hardware or wing nuts that can be separated and lost. By eliminating the wing nuts, the high hat tambourine assembly can be mounted and removed much more quickly by a user then with the use of a wing nut that required proper orientation of the hand relative to the wing nut and manipulation, as noted, to turn the wing nut at least a single or possible multiple turns or rotations to separate the device from the pull rod.

BRIEF DESCRIPTION OF THE DRAWINGS

Those skilled in the art will also appreciate the improvements and advantages that derive from the present invention upon reading the following detailed description, claims, and drawings in which:

DESCRIPTION OF THE PREFERRED EMBODIMENTS

Figure 1:
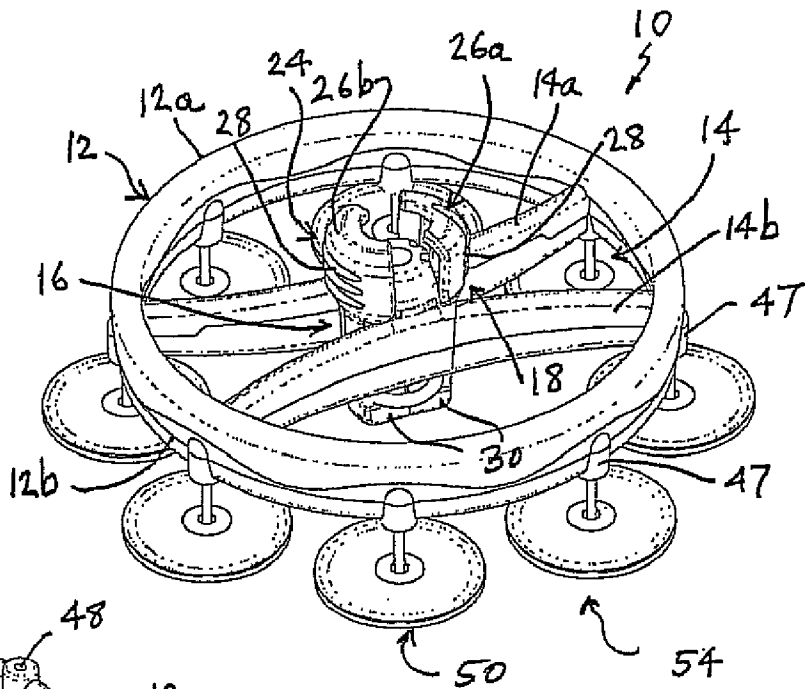
FIG. 1 is a top perspective view of a high hat tambourine assembly in accordance with the present invention using a single row or set of tambourine jingles mounted along the lower edge thereof.

Referring now specifically to the Figures, in which identical or similar parts are designated by the same reference numerals throughout, and first referring to FIG. 1, a high hat tambourine assembly in accordance with the present invention is generally designated by the reference numeral 10.

The assembly 10 includes a generally circular ring 12 that may consist of an upper ring 12*a* and a lower ring 12*b* that are molded or over-molded or otherwise secured to each other in any conventional manner. When separate upper and lower rings are used, the lower ring or main ring 12*b* is preferably made of a harder material, such as plastic, while the upper ring 12*a* is preferably made of a softer material, such as a hard rubber, for reasons to be discussed below. However, whether the ring 12 is integral, a single ring or upper and lower rings that are secured to each other is not critical for purposes of the invention.

Figure 2:
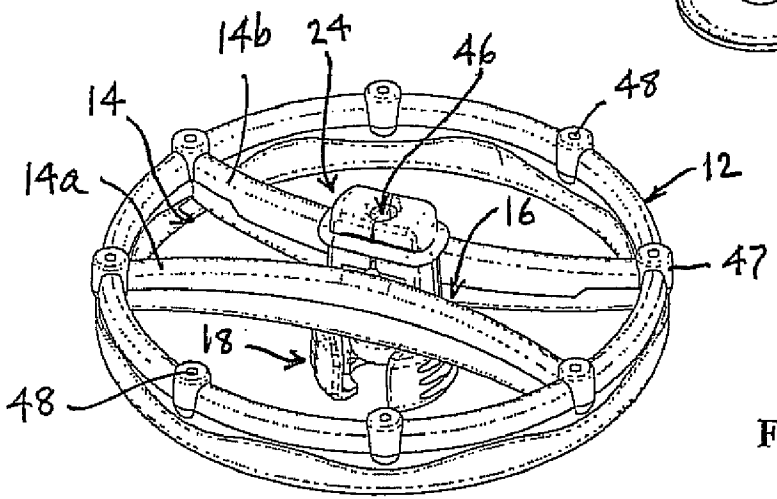
FIG. 2 is a bottom perspective view of the high hat tambourine assembly shown in FIG. 1 without the jingles.

Extending substantially diametrically within the ring 12 is a ring support 14 formed of spaced, curved cross members 14*a*, 14*b* that are inwardly curved towards the center or axis of the ring as shown. The spaced cross members define a generally central space 16 to which a central axially oriented hub 18 is fixedly secured at tangent points, as best shown in FIGS. 1 and 2. The hub 18, the cross members 14*a*, 14*b* and/or the ring 12 itself can be integrally molded as a single unit if desired.

Figure 3:
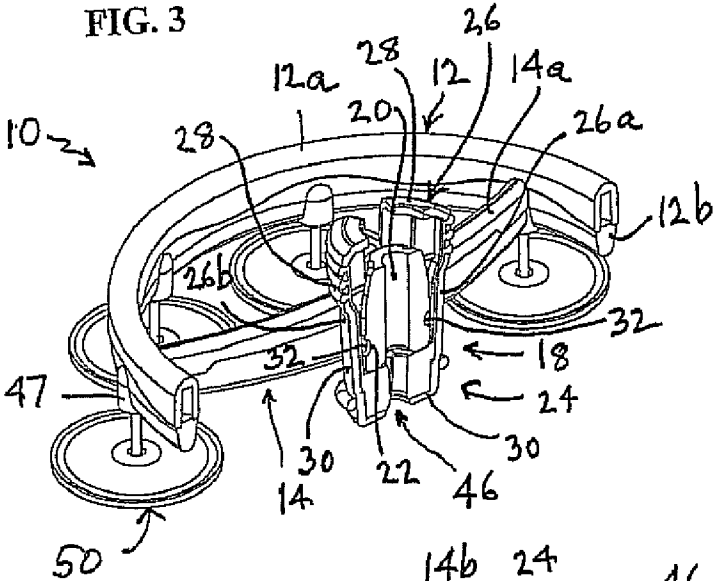
FIG. 3 is a cross-sectional view taken along a vertical cutting plane 3-3.

As best in FIG. 3, the hub 18 is fanned with an axial channel or passageway 20 that has a generally uniform circular cross-section and is dimensioned to receive a pull rod of a high hat stand with clearance so that the pull rod can be easily inserted or withdrawn from the channel with little or no friction.

A feature of the invention is the provision of a secure quick-release device 24 that cooperates with the hub 18 to effectively reduce or increase the effective diameter through which the pull rod extends, relative to the diameter of the channel 20.

The quick-release device 24 includes a pair of radially spaced clamping arms 26, in particular, 26*a* and 26*b*, that are positioned on diametrically opposite sides of the hub 18. Each clamping arm 26*a*, 26*b* includes an upper portion 28 that is accessible to be gripped by a user and a lower portion 30. The hub 18 is provided on its exterior surface with an annual groove 22 dimensioned to receive protruding ribs 32 that extend radially inwardly from each of the clamping arms 26*a*, 26*b*, so that the ribs 32 and the annual groove 22 function as a pivot. It will be clear that a user gripping the upper portions 28 and squeezing them towards each other causes the lower portions 30 to separate, effectively increasing the dimensions of a lower opening 46 relative to the diametrical dimensions of the central channel 20.

To ensure secure gripping of the assembly to the high hat pull rod, each clamping arm 26 includes a clamp over-mould 34 consisting of axially spaced transverse attachment members 36. A connecting strip 38 secures the attachment members 36 to a lower gripping member 40 that is secured within the lower portions 30 as shown. The gripping members 40 are each provided with cylindrical surfaces 42 arranged and dimensioned to generally conform to the outer surfaces of the high hat pull rod and formed of a material that enhances friction between the gripping member cylindrical surfaces 32 and the generally highly polished pull rod.

An "O" ring 44 or other biasing mechanism is used for drawing the lower portions 30 of the clamping arms 26 together and towards each other to ensure that the assembly remains intact while providing significantly high biasing forces to normally draw the lower portions 30 toward each other to whereby separate the upper portions 28 to their outermost positions. However, when the user squeezes the upper portions 28 together, the action of the "O" ring generates restoring biasing forces that can be overcome by the user's fingers and the lower opening 46 can be quickly and conveniently enlarged to mount or remove the high hat tambourine assembly very quickly.

Figure 4:
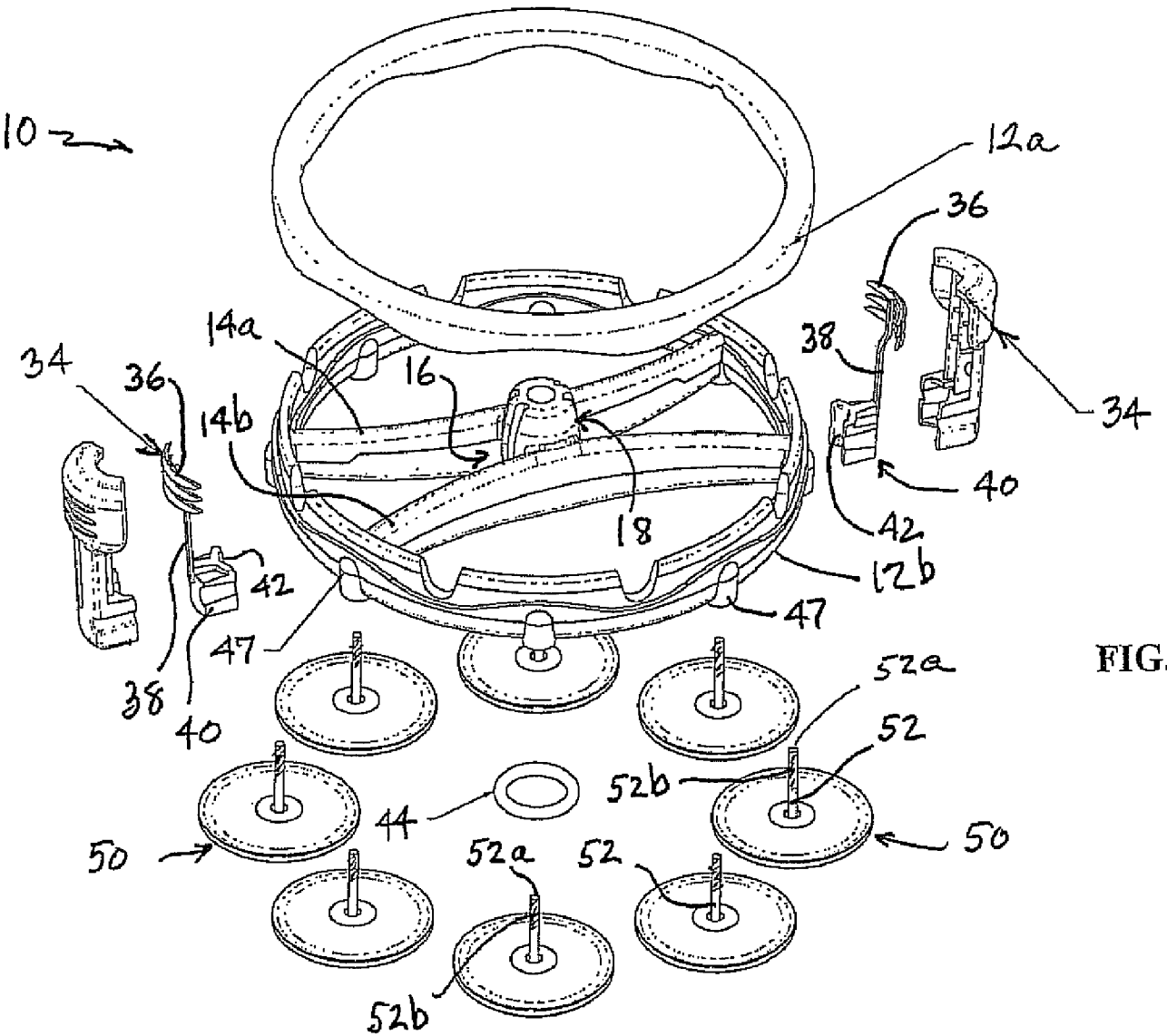
FIG. 4 is an exploded view of the high hat tambourine assembly shown in FIG. 4.
Figure 5:
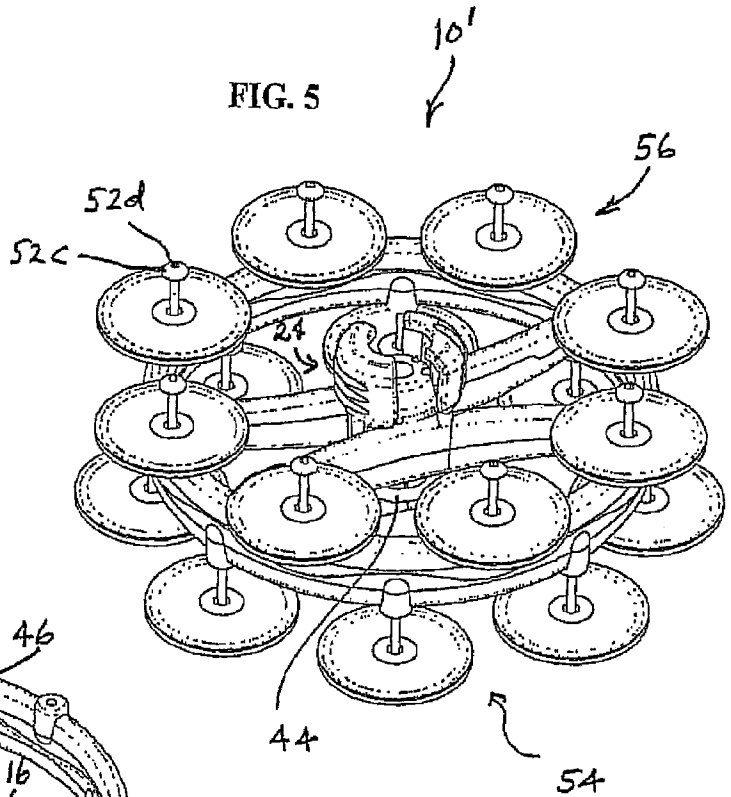
FIG. 5 is similar to FIG. 1, but showing two sets or rows of jingles mounted along the upper and lower edges of the high hat tambourine assembly.
Figure 7:
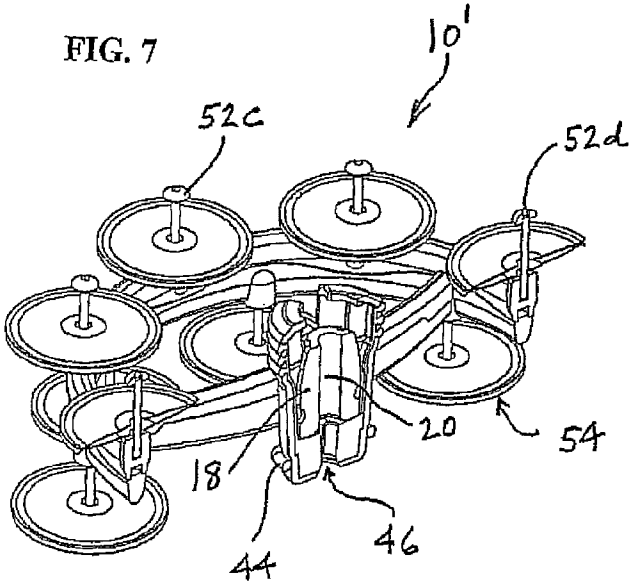
FIG. 7 is similar to FIG. 3, taken along vertical cutting plane at 7-7.
Figure 6:
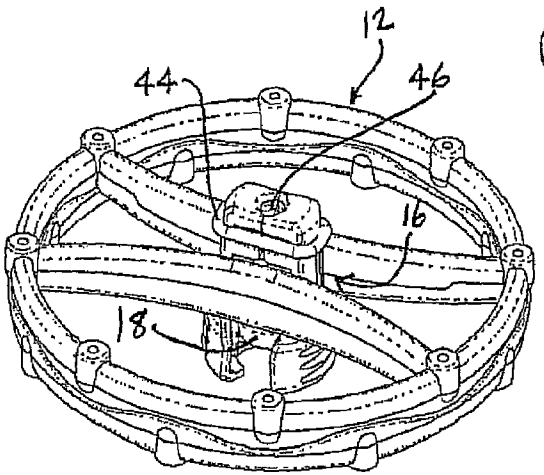
FIG. 6 is bottom perspective view of the high hat tambourine assembly shown in FIG. 5, without the jingles.
Figure 8:
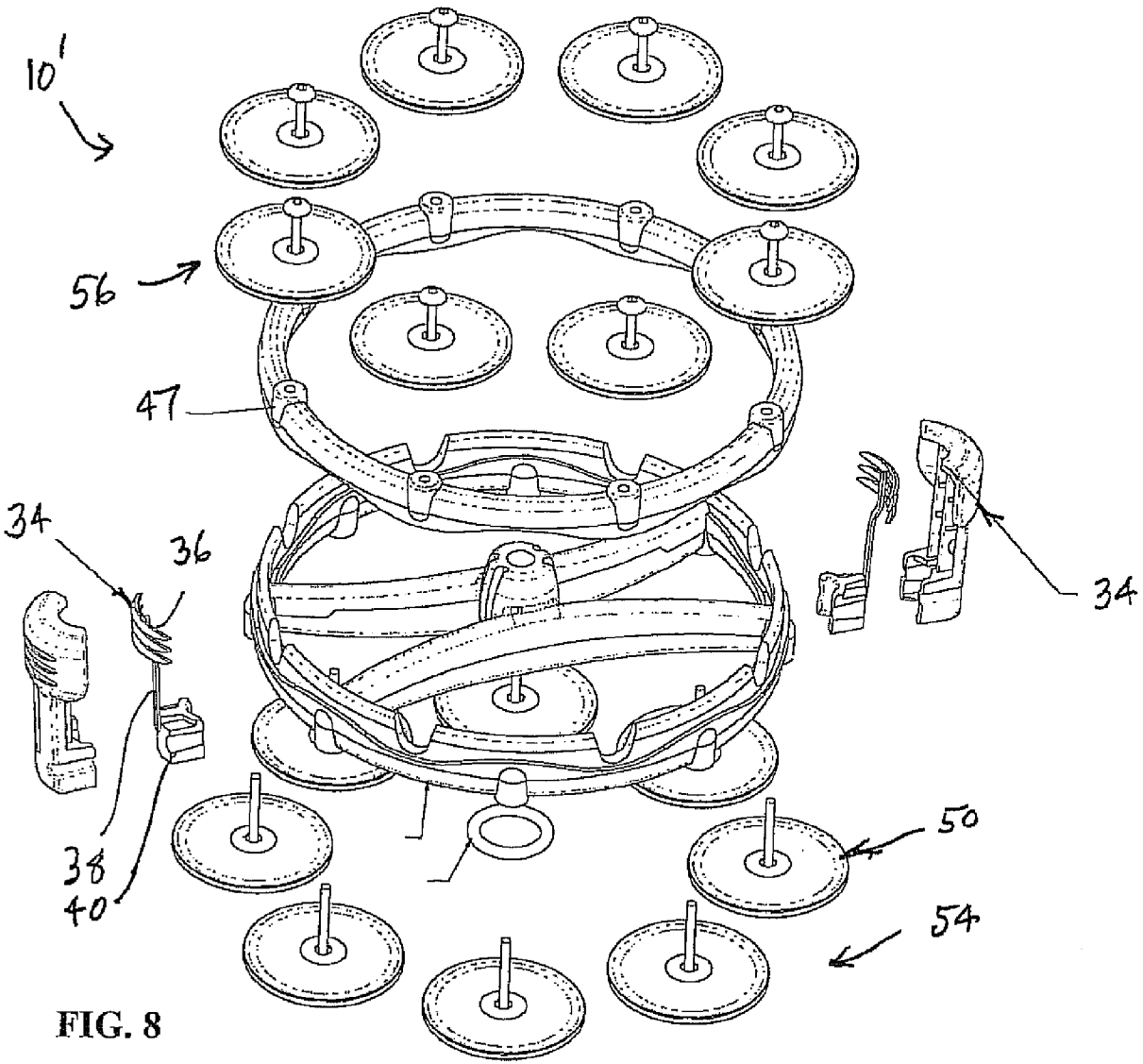
FIG. 8 is an exploded view similar to the one shown in FIG. 4 for the high hat tambourine assembly shown in FIG. 5.

The circular ring 12, whether a single ring or multiple ring construction is formed with spaced bosses 47. As best shown in FIG. 2, each of the bosses 47 is provided with a hole 48. Referring to FIG. 4, each of the jingles 50 of each pair of assembled jingles are secured to each other in a conventional and known manner and are provided with transverse or axial pins 52, the free ends 52*a* of which are dimensioned and configured to be securely received within the holes 48. Towards this end, the holes 48 may be undersized to receive the pins with press fits by expanding the holes, or the free ends 52*a* can be formed with threads 52*b* that can be used to tap into the holes 48, in which case the other free ends of the pins are provided with screw heads 52*c* and suitable driver engaging configurations, such as slots 52*d*, so that the pins can be engaged by a driver (not shown) and screwed into the bosses in a conventional manner.

Referring to FIGS. 5-8, a similar construction is shown in which another embodiment 10' is illustrated. The high hat tambourine assembly 10' is constructed as described in connection with the first embodiment, except that a second set or row of jingles are secured to the other set of spaced bosses at the upper edge of the ring 12.

The material for the gripping members are selected so that the cylindrical surfaces 42 provide sufficient friction to withstand downward forces applied to the high hat tambourine assembly of forces within the range of 6-15 lb. However, forces sufficient to withstand 10 lb downward forces have been found to be adequate for most applications. It will be appreciated that the holding forces for securing the device to the pull rod must be sufficiently high to maintain it at a desired position above the cymbals and for preventing slippage notwithstanding striking forces and vigorous up and down movements of the pull rod. The quick-release device, therefore, must do more than simply prevent upward movements against the action of gravity alone. The quick-release mechanism must provide sufficient gripping to the smooth pull rod despite its up and down movements and despite being hit downwardly and repeatedly by a drumstick. Failure to properly fix the device on the pull rod and downward slippage could quickly cause the device to contact the upper cymbal of the high hat and interfere with the effectiveness of the high hat. This would additionally require the device to be frequently repositioned and would become an annoying distraction to the drummer.

In use, it will be evident to those skilled in the art, the high hat tambourine assembly can be quickly removed or mounted on a pull rod high hat by simply squeezing the upper portions 28 towards each other to thereby effectively enlarge the opening 46 to allow free passage of a pull rod. As soon as the upper portions are released, however, the "O" ring reverts the lower portions 30 towards each other and the gripping members 40 engage the outer surface of the pull rod with sufficient force that frictional forces are created between the outer surface of a pull rod and cylindrical surfaces 42 to effectively prevent any up or down movements along the pull rod.

Although the invention has been described in connection with a tambourine assembly, the invention also contemplates the use of the relevant features in connection with any percussion instrument or accessory for use in combination with a high hat.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What claimed is:

1. A high hat tambourine assembly comprises a frame defining a plane and a frame axis generally normal to said plane;

support means arranged generally within said plane and attached to said frame and having at least a portion extending proximate to said axis;

a hub secured to said support means and defining a hub axis generally coextensive with said frame axis and having an elongate axial channel dimensioned to receive a rod of a high hat for free slidable movements of the rod relative to said hub;

quick-release means on said hub normally biased to provide an opening that is generally smaller than said elongate axial channel for restricting a rod of a high hat that extends through said axial channel and having manually engageable gripping members that frictionally engage the rod with a force sufficient to secure said hub to the rod to prevent relative slipping notwithstanding any downward striking forces applied to said frame and for allowing separation of said frame from the rod when said quick-release means is manually gripped by the hand of the user and actuated to separate said gripping members to enlarge the normally restricted opening to allow the rod to freely pass therethrough; and a plurality of jingles secured to said frame, whereby the high hat tambourine assembly can be quickly and conveniently mounted on or released from the rod with one hand of the user.

2. An assembly as defined in claim 1, wherein said frame comprises a generally circular ring.

3. An assembly as defined in claim 2, wherein said ring is made of a rigid material.

4. An assembly as defined in claim 1, wherein said support means comprises two generally diametric support cross members spaced radially from each other on opposite sides of said frame axis.

5. An assembly as defined in claim 1, wherein said quick release means comprises a pair of clamping arms mounted on said hub for movement between a normal locking position for frictionally engaging the rod extending through said axial channel and a releasing position far allowing free slideable movements between the rod and said hub.

6. An assembly as defined in claim 5, wherein said clamping arms are pivotably mounted on said hub.

7. An assembly as defined in claim 5, wherein said clamping arms are symmetrically arranged on opposite sides of said hub axis.

8. An assembly as defined in claim 5, wherein said clamping arms are each provided with gripping members for frictionally engaging the post in said normal locking position.

9. An assembly as defined in claim 8, wherein said gripping members are made of rubber.

10. An assembly as defined in claim 8, wherein said gripping members are made of an elastomeric material provided with friction-producing surface.

11. An assembly as defined in claim 1, wherein said quick release means includes biasing means for biasing said clamping arms to said normal locking position.

12. An assembly as defined in claim 11, wherein said clamping members are pivotably mounted on said hub and said biasing means comprises an elastic O-ring to urge said clamping members to move to said locking position.

13. An assembly as defined in claim 1, wherein said jingles are substantially uniformly spaced along said frame.

14. An assembly as defined in claim 1, wherein said frame has opposing edges to either side of said plane and said jingles are mounted along at least one of said edges.

15. An assembly as defined in claim 14, wherein said jingles are mounted on both said opposing edges.

16. An assembly as defined in claim 1, wherein said opening of said quick release means is axially offset from said hub and generally coextensive with said hub axis, whereby said frame cannot freely slide relative to a rod of a high hat unless it can freely slide both through said axial channel of said hub and said opening of said quick release means.

17. An assembly as defined in claim 8, wherein said gripping members are provided with generally cylindrical surfaces to conform with the external cylindrical surfaces of the post.

18. A high hat tambourine assembly comprising a frame including at least one generally circular ring defining an axis and generally diametric support cross members spaced radially from each other on opposite sides of said axis;

a hub arranged in a space between and secured to said cross members and having an elongate axial channel extending substantially along said axis for slideably receiving a rod of a high hat;

manually actuatable quick-release arms movably mounted on said hub and normally biased to provide an opening along said channel that is generally smaller than said elongate axial channel through said hub so that a rod of a high hat can extend through said axial channel and are movable between a normal locking position for frictionally engaging the rod with a force sufficient to secure said frame relative to the rod to prevent slipping therebetween notwithstanding any downward striking forces applied to said frame and a releasing position for allowing free slideable movements between the rod and said hub, said quick-release arms being capable of being gripped by one hand of a user and manually moved from said locking to said releasing positions to allow the rod to freely pass therethrough; and jingles secured to at least a portion of said ring to generate jingle and percussion sounds when at least one of said frame and said jingles are impacted or struck, whereby the high hat tambourine assembly may be quickly and conveniently mounted on or removed from a pull rod of a high hat with one hand of the user.

19. A method of moving a tambourine assembly relative to a post of a high hat wherein the assembly comprises a frame defining a plane and a frame axis generally normal to said plane;

support means arranged generally within said plane and attached to said frame and having at least a portion extending proximate to said axis;

a hub secured to said support means and defining a hub axis generally coextensive with said frame axis and having an elongate axial channel dimensioned to receive a rod of a high hat for free slidable movements of the rod relative to said hub;

quick-release means on said hub normally biased to provide an opening that is generally smaller than said elongate axial channel for restricting a rod of a high hat that extends through said axial channel and having manually engageable gripping members that frictionally engage the rod with a force sufficient to secure said hub to the rod to prevent relative slipping notwithstanding any downward striking forces applied to said frame and for allowing separation of said frame from the rod when said quick-release means is manually gripped by the hand of the user and actuated to separate said gripping members to enlarge the normally restricted opening to allow the rod to freely pass therethrough; and a plurality of jingles secured to said frame, whereby the high hat tambourine assembly can be quickly and conveniently mounted on or released from the rod with one hand of the user, the method comprising the steps of manually actuating said quick release means to enlarge said opening to be at least as large as said elongate axial channel to eliminate any frictional forces acting between said quick release means and the post to allow relative movements therebetween;

placing the assembly on the rod or removing the assembly from the rod; and releasing said quick release means to secure the assembly to the post when placing the assembly on the post.

20. An assembly as defined in claim 19, wherein said quick release means includes opposing pivotably mounted arms and said actuating step comprises squeezing said arms with the user's thumb and index fingers to separate said gripping members.

* * * * *